US005410978A

United States Patent [19]

Waclawik et al.

[11] Patent Number: 5,410,978

[45] Date of Patent: May 2, 1995

[54] FLOW-THROUGH ELASTOMERIC LAUNCH SYSTEM FOR SUBMARINES

[75] Inventors: Ronald E. Waclawik, Fairhaven, Mass.; Scott D. Boyd, Portsmouth, R.I.

[73] Assignee: The United States of America as represented by the Secretary of the Navy, Washington, D.C.

[21] Appl. No.: 294,457

[22] Filed: Aug. 22, 1994

[51] Int. Cl.[6] ..... B63B 1/00

[52] U.S. Cl. ..... 114/238; 114/319

[58] Field of Search ..... 114/318, 319, 238; 89/1.809, 1.81, 1.816, 1.819; 124/69–73; 42/1.14

[56] References Cited

U.S. PATENT DOCUMENTS

| | | | |
|---|---|---|---|
| 4,523,538 | 6/1985 | Hollmann et al. | 124/70 |
| 4,848,210 | 7/1989 | Bissonuette | 114/319 |
| 5,200,572 | 4/1993 | Bissonuette et al. | 89/1.81 |
| 5,231,241 | 7/1993 | Bissonuette | 114/238 |

*Primary Examiner*—Edwin L. Swinehart
*Attorney, Agent, or Firm*—Michael J. McGowan; Prithvi C. Lall; James M. Kasischke

[57] ABSTRACT

An apparatus for providing a pressurized liquid to a launch tube for launching projectiles into a liquid medium. The device comprises an elastomeric bladder disposed inside a cylindrical bypass tube. The bypass tube is hollow with a sealing ring disposed on the inner surface of the tube. One end of the bypass tube is open to the liquid medium, and the other end of the tube is hydraulically connected to the launch tube. The elastomeric bladder is of generally cylindrical shape with an annular thinned portion. The open end of the bladder is hydraulically connected to a valve which controls charging of the bladder, storage of liquid within the bladder and discharge of the bladder. The bladder expands when it is filled with pressurized seawater thereby causing the thinned portion of the bladder to contact the sealing ring and seal the bypass tube to prevent the external liquid medium from communicating with the launch tube through the bypass tube. Upon vehicle launch the pressurized liquid is provided from the elastomeric bladder to the launch tube. During the bladder's discharge, the seal is broken between the thinned portion of the bladder and the bypass tube, and the liquid is allowed to flow through the bypass tube into the launch tube to prevent suction from occurring at the launch tube mouth.

11 Claims, 3 Drawing Sheets

FLOW-THROUGH ELASTOMERIC LAUNCH SYSTEM FOR SUBMARINES

STATEMENT OF GOVERNMENT INTEREST

The invention described herein may be manufactured and used by or for the Government of the United States of America for governmental purposes without the payment of any royalties therefor.

CROSS-REFERENCE TO RELATED PATENT APPLICATIONS

This patent application is co-pending with a related application having common ownership on the date of invention and filed on the same date as subject patent application entitled Elastomeric Launch System for Submarines by Paul E. Moody and further identified as Navy Case No. 73349, Ser. No. 294,456filed Aug. 22, 1994.

BACKGROUND OF THE INVENTION (1) Field of the Invention

The invention relates to an elastomeric launch system, and more specifically to a submarine low-noise projectile launching system.

(2) Description of the Prior Art

Existing submarine weapon launch systems are mechanisms which eject a torpedo or other device from the submarine by pumping a working fluid, usually seawater, behind the device in the launch tube. The two most common launch devices are the ram pump and turbine pump ejection systems. Both systems are mechanically complex and tend to radiate noise into the surrounding fluid medium.

A ram pump launch apparatus converts potential energy from compressed air stored in a flask into working fluid kinetic energy. The ram pump system utilizes a massive piston apparatus to transfer sufficient working fluid, such as seawater, to launch a projectile. The mechanical friction and the mass of the piston act to reduce system efficiency and to produce substantial radiated noise. The ram pump system requires frequent maintenance because the system includes numerous mechanical components, in addition to the piston assembly.

A turbine pump launch apparatus also converts potential energy in the form of compressed air stored in a flask into kinetic energy of a working fluid. An air turbine drive unit is joined with a rotary impeller pump via a speed reduction unit. The turbine pump system is costly because of the complexity of the required mechanical components and is also noisy due to dynamic interaction of many of the system components.

In U.S. Pat. No. 4,848,210, issued Jul. 18, 1989 to Laurent C. Bissonnette, there is shown and described an elastomeric impulse energy storage and transfer system. The '210 system as shown is adapted to a torpedo launch system wherein an elastomeric bladder is distended by filling it with pressurized working fluid. When an impulse of energy is desired the elastomeric bladder discharges the working fluid to quietly eject a projectile from the launch system into the surrounding liquid. The elastomeric bladder used is generally spherical containing, when expanded, volume sufficient to fill the launch tube and the launchway forward of the launch tube.

Following expulsion of seawater from the elastomeric bladder, a low pressure region forms at the mouth of the launch tube because of the finite nature of the fluid volume available in the bladder and the competing momentum of the fluid exiting the launch tube. This low pressure region is undesirable because it causes excessive noise due to cavitation. To prevent the pressure differential and the noise associated therewith, additional seawater must be available to the launch tube after the elastomeric bladder has been discharged.

SUMMARY OF THE INVENTION

Accordingly, it is a general purpose and object of the present invention to provide an even flowing, quiet launch system for submarines.

A further object of the invention is to provide a weapon launch system which, after firing, does not create additional noise because of a low pressure region forming at the mouth of the launch tube.

Still another object is that the system be simple, reliable and low in cost.

With the above and other objects in view, as will hereinafter appear, a feature of the present invention is the provision of an apparatus for providing pressurized liquid to a launch tube for launching projectiles into a liquid medium. The device comprises an elastomeric bladder disposed inside a cylindrical bypass tube. The bypass tube is hollow with a sealing ring disposed on the inner surface of the tube. The forward end of the bypass tube is open to the liquid medium, and the aft end of the tube is hydraulically connected to the launch tube. The elastomeric bladder is of generally cylindrical shape and has an open aft end and a closed forward end with an annular thinned portion between the ends. The open end of the bladder is hydraulically connected to a valve. The valve acts to control charging of the bladder, storage of liquid within the bladder, and discharge of the bladder. The bladder expands when it is pumped full of pressurized seawater. On expanding the thinned portion of the bladder seals the bypass tube by contact with the sealing ring to prevent the external liquid medium from communicating with the launch tube through the bypass tube. To launch a vehicle, the pressurized liquid is provided from the elastomeric bladder through the valve to the launch tube. The bladder returns to its original shape after discharge thereby breaking the seal between the thinned portion of the bladder and the bypass tube sealing ring. The liquid is thereby allowed to flow through the bypass tube into the launch tube to prevent suction from occurring at the launch tube mouth.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

A more complete understanding of the invention and many of the attendant advantages thereto will be readily appreciated as the invention becomes better understood by reference to the following detailed description when considered in conjunction with the accompanying drawings wherein.

DESCRIPTION OF THE PREFERRED EMBODIMENT

Figure 1:
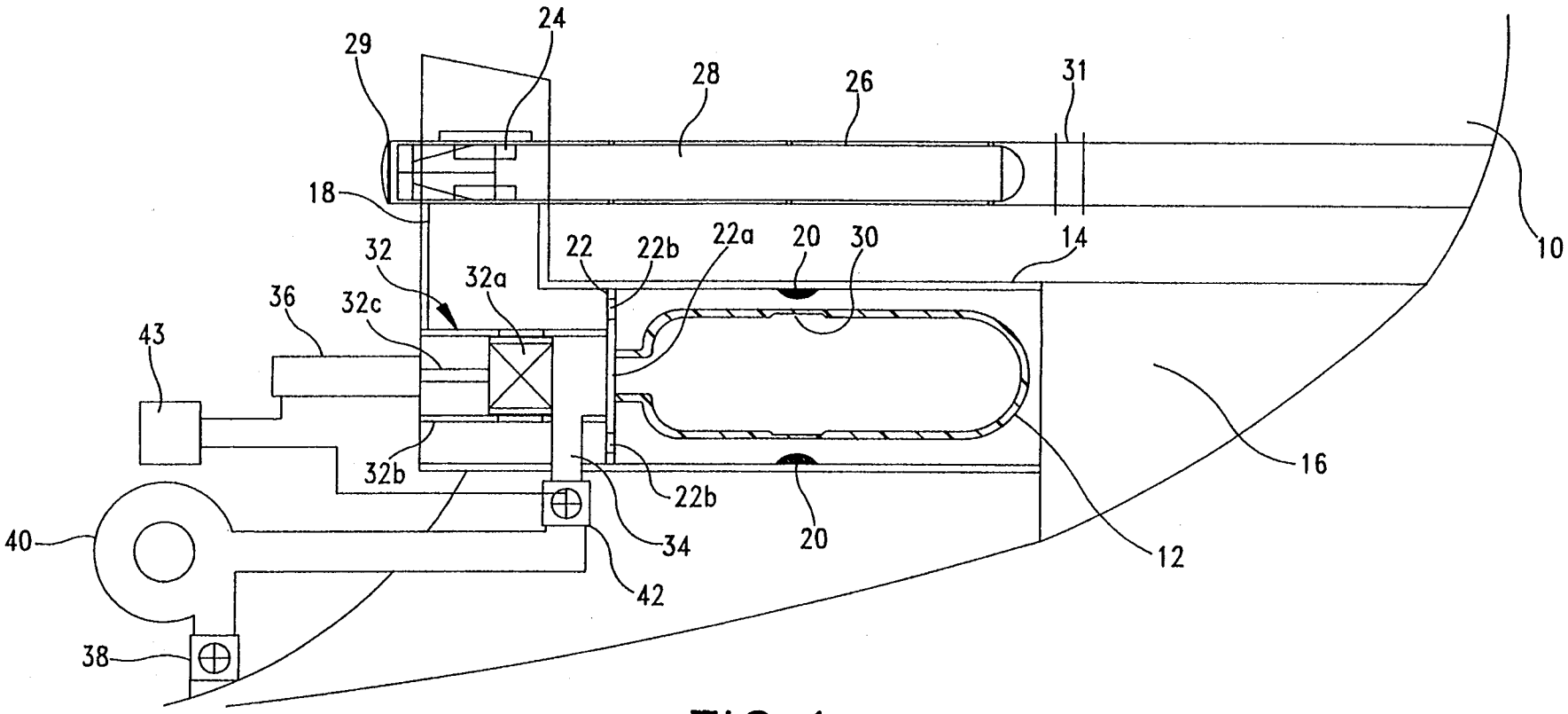
FIG. 1 is a diagrammatic view of the bow of a submarine cut away to display the launch device of the current invention as set for charging.

Referring now to FIG. 1 there is shown diagrammatic view of the bow of a submarine cut away to display the launch mechanism. The launch mechanism of the current invention is disposed within the ensuing drawings with references to forward being toward the bow of submarine 10 and references to aft being toward the rear of submarine 10; however, provided directions should not be read to limit the invention to the specified orientation. The launch mechanism comprises an elastomeric bladder 12 mounted within a cylindrical bypass tube 14. Bladder 12 is made from NEOPRENE ® rubber, urethane, natural rubber or the like. Bypass tube 14 is a rigid cylinder with the forward end open to a free flood sea chest 16 and the aft end open to an impulse tank 18. Sea chest 16 is open to seawater at the same pressure as the outside of submarine 10. A sealing ring 20 is fixed around the inner surface of bypass tube 14. Elastomeric bladder 12 is mounted in bypass tube 14 by a spyder 22. Spyder 22 is a support structure having an inner flow aperture 22*a* surrounded by a plurality of outer flow apertures 22*b*. Spyder 22 suspends bladder 12 at the center of bypass tube 14 and allows hydraulic communication between bladder 12 and impulse tank 18 through inner flow aperture 22*a*. Flow between bypass tube 14 and impulse tank 18 occurs around the outside of bladder 12 through outer flow apertures 22*b*.

Impulse tank 18 is hydraulically connected to one or more tube slots 24 in the walls of a launch tube 26 behind a device to be launched, such as a torpedo 28. Torpedo 28 is loaded in launch tube 26 through a breech valve 29. Impulse tank 18 provides a hydraulic impulse behind torpedo 28 to expel it from tube 26 via a muzzle valve 31.

Bladder 12 is substantially cylindrical having a closed end positioned toward the open end of bypass tube 14 and an open end positioned toward spyder 22. Bladder 12 has a thinned section 30 around the circumference of bladder 12 positioned to correspond with sealing ring 20. Upon charging, thinned section 30 of bladder 12 will first expand to contact sealing ring 20. While bladder 12 is discharging, thinned section 30 is the last part of bladder 12 to unseat from sealing ring 20. The material and thickness of bladder 12 are selected to provide the desired impulse profile. The open end of bladder 12 is in communication with a charge/firing valve 32.

Charge/firing valve 32 is positioned in hydraulic communication with elastomeric bladder 12, impulse tank bypass tube 14, and a seawater inflow tube 34. Charge/firing valve 32 is cylindrical with a movable piston 32*a* disposed within a valve cylinder 32*b*. Piston 32*a* is postionable by shipboard hydraulics 36 connected to a control rod 32*c*. To allow use of seawater to charge bladder 12, a charge sea valve 38 is provided in communication with a pump 40. Pump 40 is joined to a charge backup valve 42 which is in communication with seawater inflow tube 34. Hydraulics 36, pump 40, and valves 38 and 42 are actuated on command from control circuitry 43.

Figure 2A:
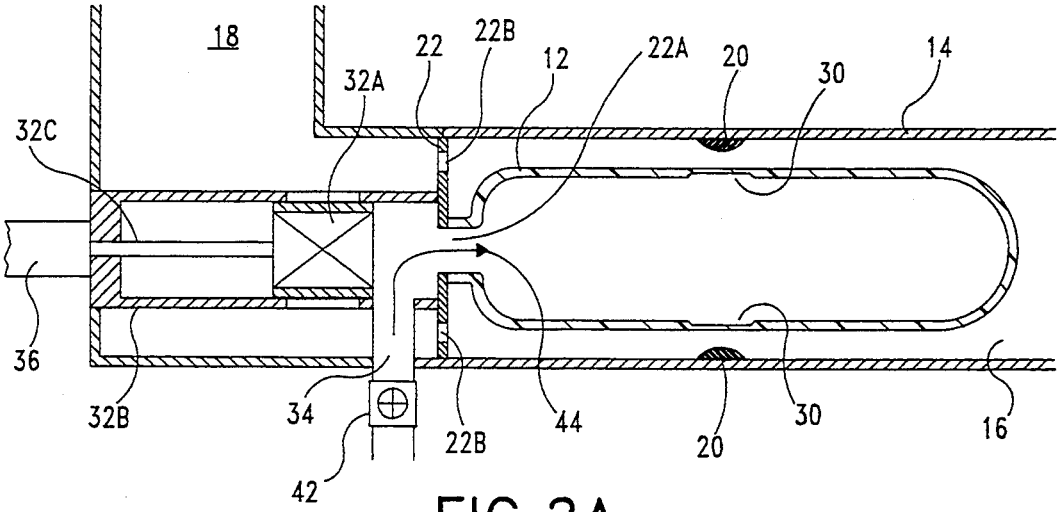
FIG. 2A is a detail view showing the fluid flow around the charge/firing valve and elastomeric bladder during charging.
Figure 2B:
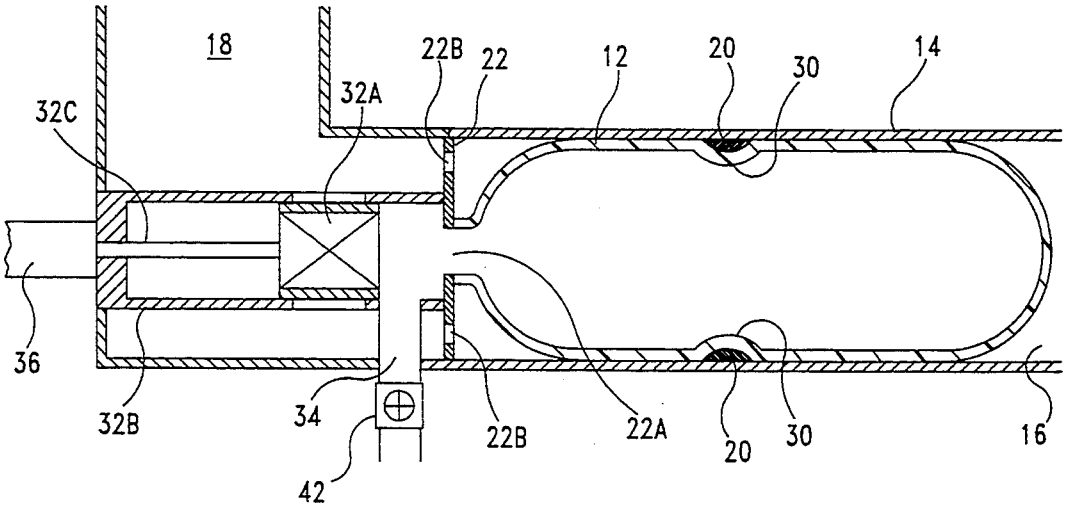
FIG. 2B is a detail view showing the charge/firing valve and elastomeric bladder after charging.
Figure 2C:
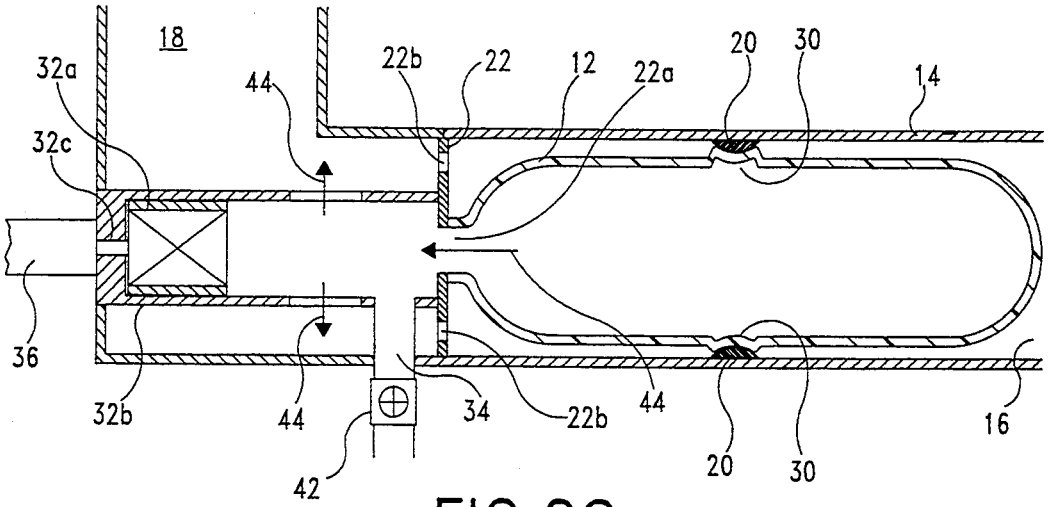
FIG. 2C is a detail view showing the fluid flow around the charge/firing valve and elastomeric bladder during launch.
Figure 2D:
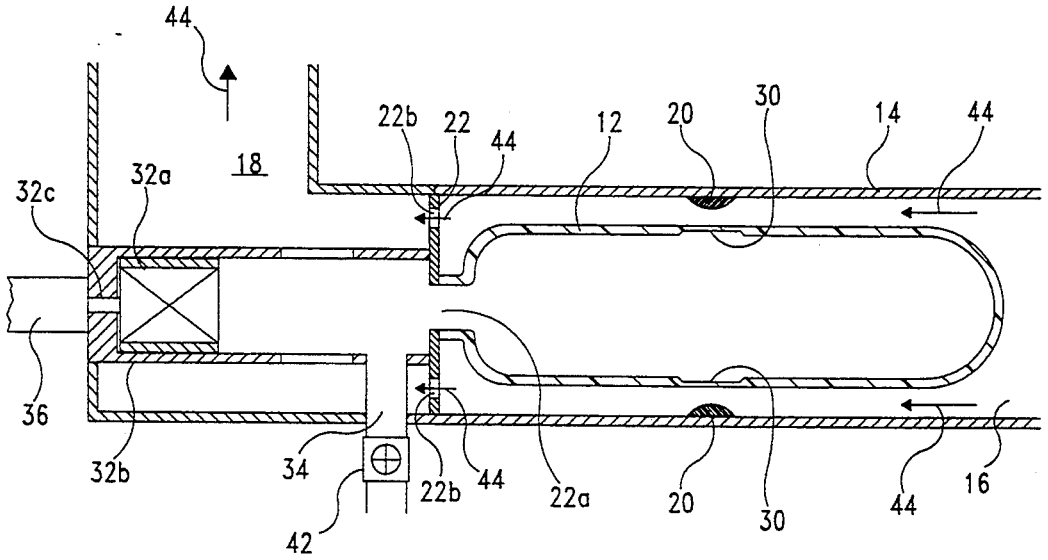
FIG. 2D is a detail view showing the fluid flow around the charge/firing valve and elastomeric bladder immediately after launch.

FIG. 2A, 2B, 2C and 2D show fluid flows through the elastomeric launch system during different stages of the launch process. In FIG. 2A, 2B, 2C and 2D, the flow of seawater is designated generally by flow arrows 44. Charge/firing valve 32 has a charge position shown in FIG. 2A, a storage position shown in FIG. 2B, and a firing position shown in FIG. 2C and 2D. FIG. 2A illustrates fluid flow with valve 32 in charge position. In FIG. 2B charge/firing valve 32 remains in the charge position and backup valve 42 is closed to seal pressure within elastomeric bladder 12. In FIG. 2C charge/firing valve 32 is shown shifted to the firing position to allow hydraulic communication between elastomeric bladder 12 and impulse tank 18. Flow arrows 44 show the initial flow of seawater from elastomeric bladder 12 through valve 32 into impulse tank 18. FIG. 2D shows fluid flow around valve 32 after the initial impulse of the launch. Flow arrows 44 show fluid flow through spyder 22 and into impulse tank 18.

In FIG. 2A, there is shown the inventive device with valve 32 positioned to allow charging of bladder 12 from seawater inflow tube 34. In this position of valve 32, the open aft end of bladder 12 is sealed from communication with impulse tank 18. As shown in FIG. 1, charge sea valve 38 is opened to allow pump 40 to pump seawater through opened charge backup valve 42 into elastomeric bladder 12 via inner flow aperture 22*a*. When the desired pressure is attained, charge backup valve 42 and sea valve 38 are closed. See FIG. 1.

Referring now to FIG. 2B, there is shown the inventive device in its charged state. In this position of valve 32, aft end of bladder 12 is completely sealed by valve 32. Elastomeric bladder 12 deforms radially to cause contact between thinned section 30 of elastomeric bladder 12 and sealing ring 20 thereby sealing bypass tube 14 and preventing liquid from entering impulse tank 18 through outer flow apertures 22*b*, bypass tube 14, and sea chest 16. Contact between bladder 12 and bypass tube 14 is not required at any location other than thinned section 30 and sealing ring 20. Contact between bladder 12 and bypass tube 14 can cause excessive wear to bladder 12.

Referring now to FIG. 2C, when torpedo 28 is ready for launch, charge/firing valve 32 is shifted to firing position to allow pressurized seawater to flow from elastomeric bladder 12 through inner flow aperture 22*a* into impulse tank 18. In FIG. 1, pressure in impulse tank 18 is transmitted to launch tube 26 to eject torpedo 28 therein. Thinned section 30 is the last portion of bladder 12 to contract thus preventing the seawater in impulse tank 18 from escaping through spyder 22 and bypass tube 14.

Referring now to FIG. 2D, as the seawater in elastomeric bladder 12 and impulse tank 18 is discharged, the thinned section 30 unseats from seal ring 20. At this stage, the pressure in impulse tank 18 will be less than the pressure in sea chest 16 and seawater will flow through bypass tube 14 around deflated elastomeric bladder 12 through spyder 22 outer flow apertures 22*b* and then to launch tube 26. Seawater flowing through impulse tank 18 avoids the creation of a negative pressure at the mouth of launch tube 26 by providing a gradual reduction of seawater flow thereby filling the area behind launched torpedo 28. See FIG. 1.

The primary advantage of the present invention over elastomeric launchers such as the launcher shown in U.S. Pat. No. 4,848,210 is that the launcher of the present invention prevents a negative pressure from forming at the mouth of the launch tube after launching a device. The negative pressure is prevented by providing a bypass cylinder which allows seawater to flow around the elastomeric bladder and into the launch tube after firing. During charging, the elastomeric bladder seals against the bypass tube and prevents transmission of seawater to the launch tube.

What has thus been described is an elastomeric launch system with seawater flow through a bypass tube allowing a device to be launched from a launch tube with reduced noise. Noise is reduced by providing fluid flow through the launch tube after the launch.

Obviously many modifications and variations of the present invention may become apparent in light of the above teachings. For example: multiple annular sealing rings can be provided on the interior surface of the bypass tube to provide better sealing between the elastomeric bladder and the bypass tube; the impulse tank can be omitted by piping seawater directly to the launch tube from the apparatus; the sealing ring can have many different shapes; and any charge/firing valve assembly can be used with this device.

In light of the above, it is therefore understood that within the scope of the appended claims, the invention may be practiced otherwise than as specifically described.

What is claimed is:

1. A flow through elastomeric bladder apparatus for providing pressurized fluid to a destination comprising:

a cylindrical bypass tube having a forward end, an aft end and at least one annular sealing ring disposed between said forward end and said aft end on the inner surface of said bypass tube, said forward end of said bypass tube being in communication with a low pressure liquid medium, and said aft end of said bypass tube being in hydraulic communication with said destination; and an elastomeric bladder fixed centrally within said bypass tube having a forward end, an aft end, and a wall portion, said forward end being sealed, said aft end having a mouth joined to communicate hydraulically with said destination, and said wall portion having an annular thinned portion positioned to correspond with said annular sealing ring in said bypass tube.

2. The apparatus of claim 1 further comprising:

a charge/firing valve in hydraulic communication between said elastomeric bladder and said destination, said valve being sealed to said mouth of said elastomeric bladder, and in hydraulic communication with and sealed to said destination, said charge/firing valve positionable to allow charging of said elastomeric bladder, storage of pressurized liquid in said elastomeric bladder, and discharge of said elastomeric bladder to said destination; and a pump having a low pressure inlet in hydraulic communication with said liquid medium and a high pressure outlet in hydraulic communication with said charge/firing valve.

3. The apparatus of claim 2 further comprising an impulse tank interposed in hydraulic communication between said launch tube and said charge/firing valve, said impulse tank interposed in hydraulic communication between said launch tube and said bypass tube.

4. The apparatus of claim 3 wherein said elastomeric bladder is made from a Neoprene rubber material.

5. The apparatus of claim 3 wherein said elastomeric bladder is made from a polyurethane rubber material.

6. The apparatus of claim 3 wherein said elastomeric bladder is made from a natural rubber material.

7. An apparatus for ejecting cylindrical projectiles into a liquid medium comprising:

at least one cylindrical launch tube, each said tube having a longitudinal axis, a muzzle end, a breech end, and a tube wall with an internal diameter greater than the diameter of said projectile, said wall having at least one aperture therein near the breech end of said tube, said tube provided for housing said projectile and slidably guiding said projectile during said ejection;

breech valve means, one each fixedly attached to said breech end of each said launch tube, for providing access to the interior volume of each said launch tube from said breech end for loading said projectiles;

muzzle valve means, one each fixedly attached to said muzzle end of each said launch tube, for providing egress for said projectiles from each said launch tube into said liquid medium;

a cylindrical bypass tube having a forward end, an aft end and at least one annular sealing ring disposed between said forward end and said aft end on the inner surface of said bypass tube, said forward end of said bypass tube being open and in communication with said liquid medium, and said aft end of said bypass tube being in hydraulic communication with said aperture in said launch tube;

a support means disposed within said bypass tube at said aft end of said bypass tube;

an elastomeric bladder supported centrally within said bypass tube by said support means having a forward end, an aft end, and a wall portion, said forward end being sealed, said aft end being open, and said wall portion having an annular thinned portion positioned to correspond with said annular sealing ring in said bypass tube;

a charge/firing valve in hydraulic communication with and sealed to said open aft end of said elastomeric bladder, said charge/firing valve in hydraulic communication with and sealed to said aperture in said launch tube, said charge/firing valve positionable to allow charging of said elastomeric bladder, storage of pressurized liquid in said elastomeric bladder, and discharge of said elastomeric bladder to said aperture in said launch tube; and a pump having a low pressure inlet in hydraulic communication with said liquid medium and a high pressure outlet in hydraulic communication with said charge/firing valve.

8. The apparatus of claim 7 further comprising an impulse tank interposed in hydraulic communication between said launch tube aperture and said charge/firing valve, said impulse tank interposed in hydraulic communication between said launch tube aperture and said bypass tube.

9. The apparatus of claim 8 wherein said elastomeric bladder is made from a Neoprene rubber material.

10. The apparatus of claim 8 wherein said elastomeric bladder is made from a polyurethane rubber material.

11. The apparatus of claim 8 wherein said elastomeric bladder is made from a natural rubber material.

* * * * *